US006370830B1

(12) United States Patent
Björkman

(10) Patent No.: US 6,370,830 B1
(45) Date of Patent: Apr. 16, 2002

(54) FRAME STRUCTURE FOR MOUNTING BETWEEN TWO BALCONY SLABS POSITIONED ONE ABOVE THE OTHER

(75) Inventor: Lars Björkman, Växjö (SE)

(73) Assignee: Nordiska Balco AB, Växjö (SE)

( * ) Notice: Subject to any disclaimer, the term of this patent is extended or adjusted under 35 U.S.C. 154(b) by 0 days.

(21) Appl. No.: 09/685,325

(22) Filed: Oct. 6, 2000

Related U.S. Application Data

(63) Continuation of application No. PCT/SE99/00423, filed on Mar. 18, 1999.

(30) Foreign Application Priority Data

Apr. 7, 1998 (SE) ..... 9801210

(51) Int. Cl.[7] ..... E04H 9/16

(52) U.S. Cl. ..... 52/235; 52/234; 52/236.3; 52/302.3; 52/209

(58) Field of Search ..... 52/234, 235, 236.3, 52/302.3, 302.6, 209

(56) References Cited

U.S. PATENT DOCUMENTS

| | | | | | |
|---|---|---|---|---|---|
| 2,714,430 | A | * | 8/1955 | Peterson | 52/235 |
| 2,885,040 | A | * | 5/1959 | Grossman | 52/234 |
| 2,949,981 | A | * | 8/1960 | Ferrell | 52/234 |
| 3,001,245 | A | * | 9/1961 | Gillett et al. | 52/235 |
| 3,147,518 | A | * | 9/1964 | Horgan, Jr. | 52/235 |
| 3,362,123 | A | * | 1/1968 | Geyser | 52/209 |
| 3,561,182 | A | * | 2/1971 | Madl, Jr. | 52/235 |
| 3,788,389 | A | * | 1/1974 | Waters | 165/45 |
| 3,844,077 | A | * | 10/1974 | Vance | 52/209 |
| 3,858,375 | A | * | 1/1975 | Silvernail | 52/235 |
| 3,866,369 | A | * | 2/1975 | Paull | 52/209 |
| 3,996,710 | A | * | 12/1976 | Nuss | 52/616 |
| 4,050,201 | A | * | 9/1977 | Hubbard et al. | 52/97 |
| 4,545,161 | A | * | 10/1985 | Baumann | 52/235 |
| 4,958,468 | A | * | 9/1990 | Nolan | 52/204 |
| 5,253,459 | A | * | 10/1993 | Parinas et al. | 52/235 |
| 5,906,083 | A | * | 5/1999 | Olsen et al. | 52/473 |

FOREIGN PATENT DOCUMENTS

| | | | | |
|---|---|---|---|---|
| EP | 474582-a1 | * | 8/1991 | 52/209 |
| EP | 0474582 | | 3/1992 | |
| EP | 0596848 | | 5/1994 | |
| WO | 95/22664 | | 8/1995 | |
| WO | WO 95/22664 | | 8/1995 | |
| WO | WO 96/24739 | | 8/1996 | |
| WO | 99/51825 | | 10/1999 | |

* cited by examiner

*Primary Examiner*—Carl D. Friedman
*Assistant Examiner*—Phi Dieu Tran A
(74) *Attorney, Agent, or Firm*—Burns, Doane, Swecker & Mathis L.L.P.

(57) ABSTRACT

A frame structure, which is adapted to be mounted between a horizontal lower balcony slab (1) and a horizontal upper balcony slab (2) located straight above the former, is arranged to support wall plates (9, 10) for at least partial building-in of the space between the balcony slabs (1, 2). The frame structure has a lower horizontal sectional element (12) arranged to be attached to the lower balcony slab (1), an upper horizontal sectional element (11) arranged to be attached to the upper balcony slab (2), an intermediate horizontal sectional element (13) and two vertical sectional elements (14, 15). The upper and the intermediate horizontal sectional elements (11 and 13) are arranged to support between themselves wall plates (10), such as glass plates, which are horizontally displaceable relative to each other. The vertical sectional elements (14, 15) consist of hollow sectional elements. The intermediate horizontal sectional element (13) has a longitudinal draining groove (21), which leads into the hollow sectional element (14, 15).

5 Claims, 3 Drawing Sheets

Figure 1:
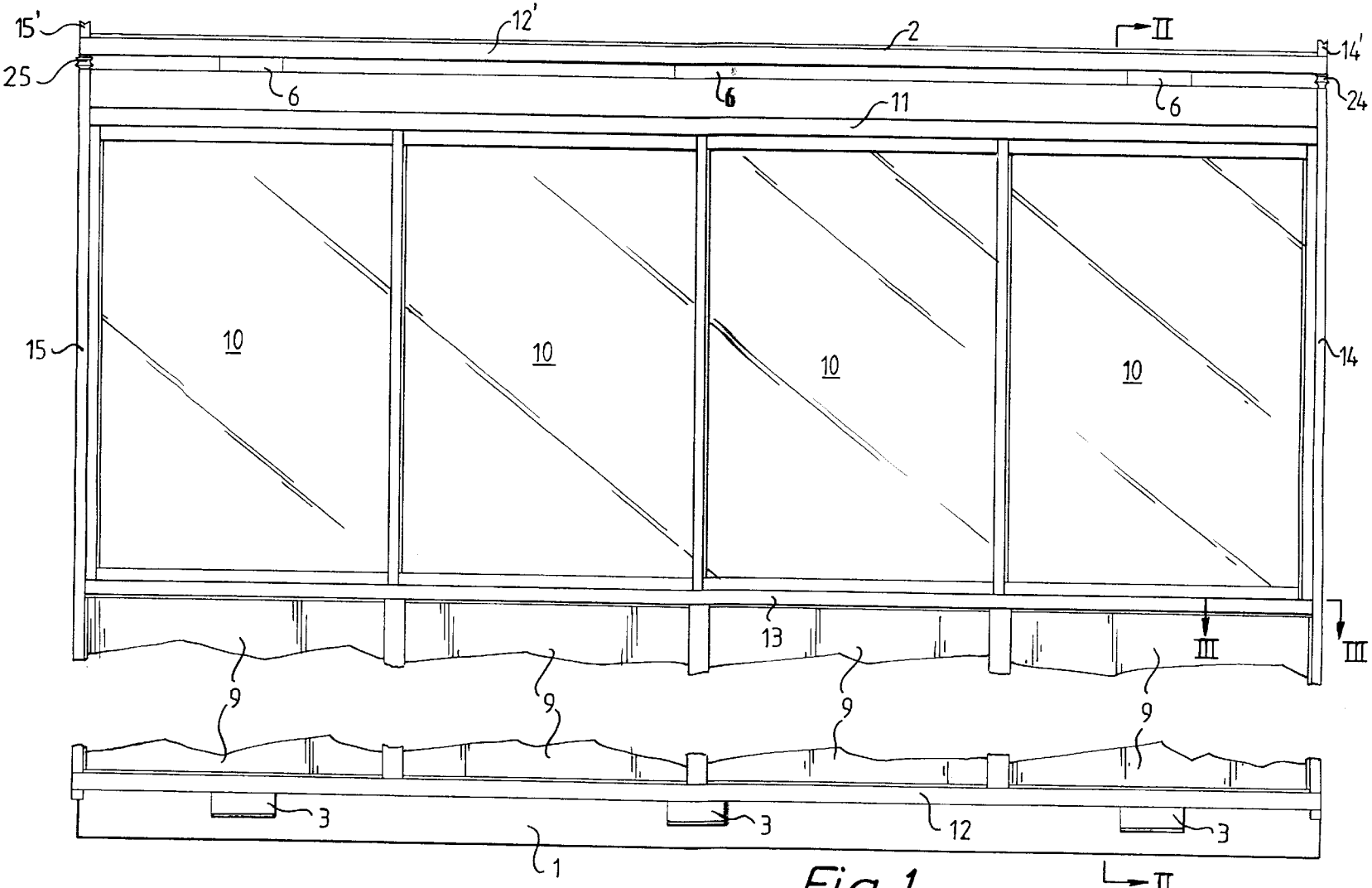

FRAME STRUCTURE FOR MOUNTING BETWEEN TWO BALCONY SLABS POSITIONED ONE ABOVE THE OTHER

This is a continuation of International Application No. PCT/SE99/00423, filed Mar. 18, 1999 that designates the United States of America, and claims priority for the filing of Swedish Application No. 9801210-7, filed Apr. 7, 1998.

The present invention relates to a frame structure, which is adapted to be mounted between a horizontal lower balcony slab and a horizontal upper balcony slab located straight above the former and is arranged to support wall plates for at least partial building-in of the space between the balcony slabs and which has a lower horizontal sectional element arranged to be attached to the lower balcony slab, an upper horizontal sectional element arranged to be attached to the upper balcony slab, an intermediate horizontal sectional element and two vertical sectional elements, the upper and the intermediate horizontal sectional elements being arranged to support between themselves wall plates, such as glass plates, which are horizontally displaceable relative to each other.

In a frame structure of this type, which is known from Swedish patent specification 9400600-4, the intermediate horizontal sectional element has three parallel ribs at its upper side, which extend in the longitudinal direction of the sectional element and constitute guides for a respective one of the glass plates which are horizontally displaceable thereon. The intermediate horizontal sectional element upper side which is somewhat inclined downwards to the outside of the frame structure, is extended outwards by a draining metal plate or drip metal plate which extends along the whole intermediate horizontal sectional element. This metal plate is somewhat more inclined downwards than said upper side. The two guide ribs nearest the outside of the frame structure have a plurality of through holes which are positioned nearest the upper side of the intermediate horizontal sectional element and which allow water to pass. Water, which collects in the ducts between the guide ribs, flows through these holes out on the metal plate and, thus, does not remain in these ducts. Consequently, the water is drained off via the metal plate. However, there is a great risk that the water, for instance owing to strong winds, is pressed against the outside of the balcony wall and flows down along the same, and further down to the outside of an underlying balcony wall etc. As a result, the balcony walls get dirty, which, naturally, is unsatisfactory.

The object of the present invention is therefore to provide a frame structure which eliminates this disadvantage and, consequently, drains off water without making the balcony walls dirty.

According to the invention, this object is achieved by a frame structure which is of the type stated by way of introduction and is characterised in that at least one of the two vertical sectional elements is a hollow sectional element, and that the intermediate horizontal sectional element has a water collecting means, which forms a longitudinal draining groove, which leads into the hollow sectional element.

The intermediate horizontal sectional element is conveniently a hollow sectional element, the interior of which forms said groove and which in its upper part has holes which are arranged to conduct water into this hollow sectional element. Preferably the hollow sectional element, which forms the intermediate horizontal sectional element, has in its bottom a groove-shaped depression which forms said groove.

In a preferred embodiment at least one of said vertical sectional elements has at its upper and/or lower end a tubular connecting element, which makes it possible to connect this vertical sectional element to a corresponding sectional element of an identical frame structure located above and/or below the vertical sectional element. The connecting element conveniently consists of a rubber sleeve.

Figure 2:
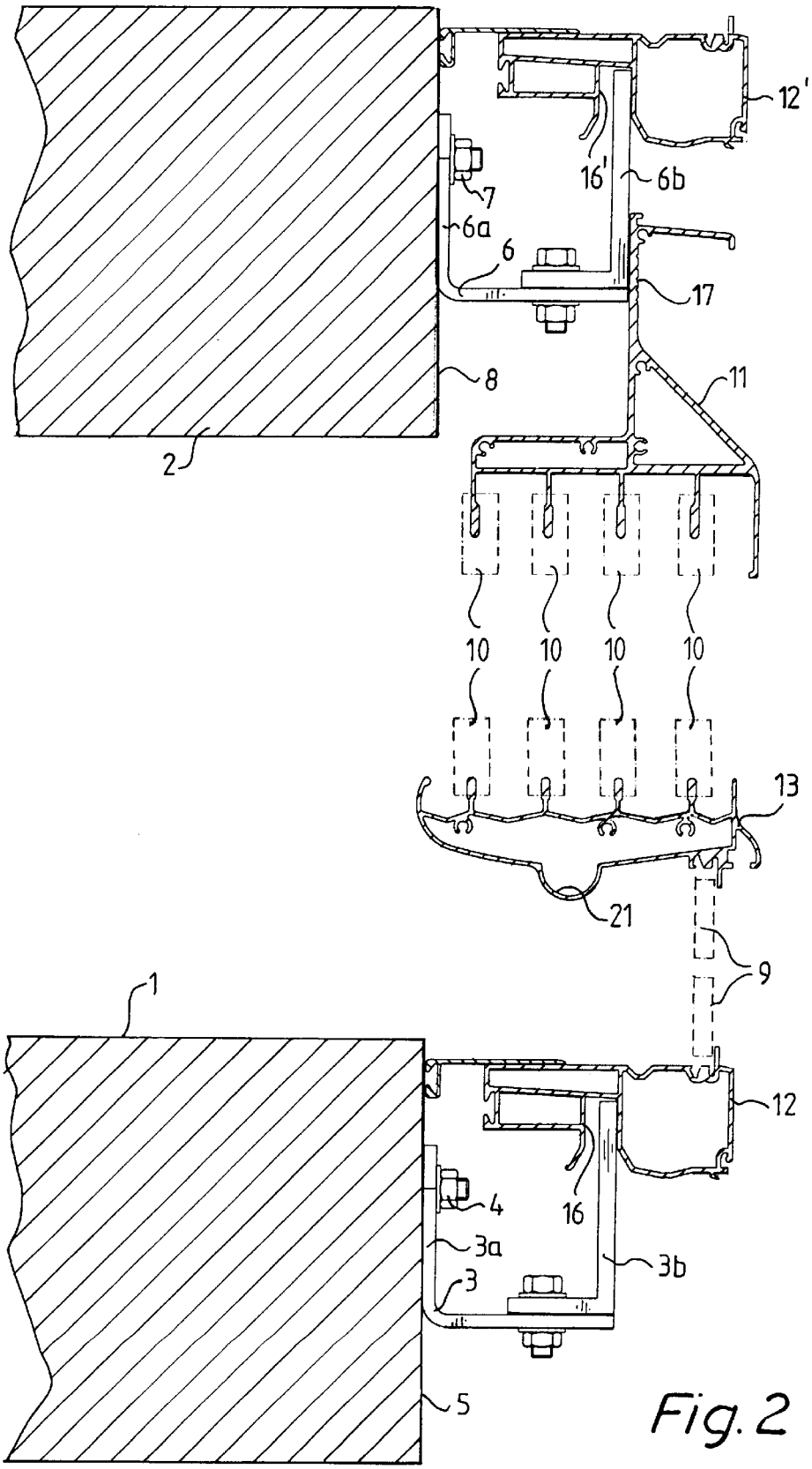
Figure 3:
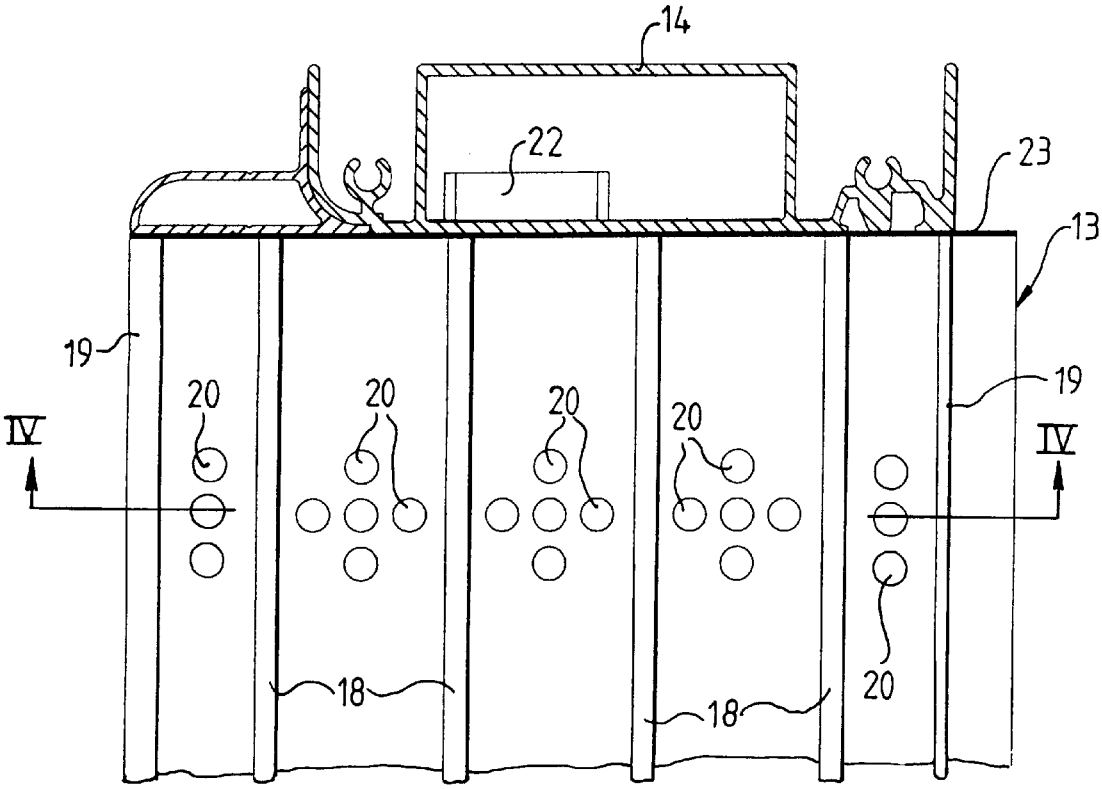
Figure 4:
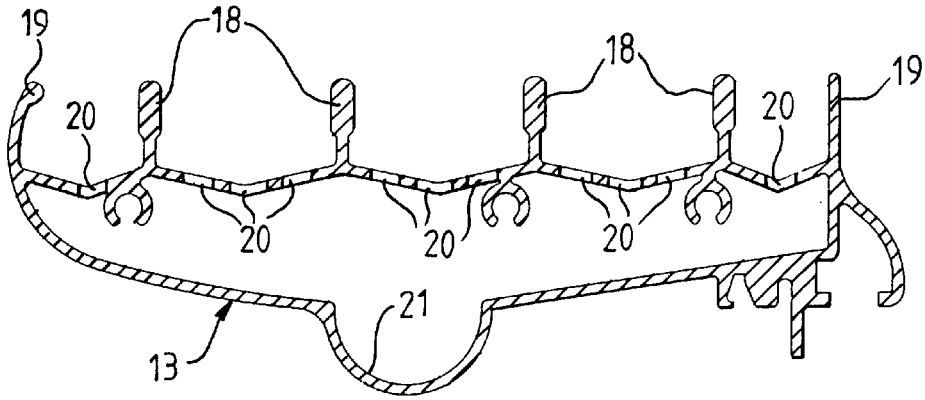

The invention will now be described in more detail with reference to the accompanying drawings, in which:

FIG. 1 is a front view and shows a built-in balcony which is provided with a frame structure according to the invention, FIG. 2 is an enlarged sectional view along the line II—II in FIG. 1, three of four glass plates being shown displaced to the right in relation to FIG. 1, FIG. 3 is an enlarged sectional view along the line III—III in FIG. 1 and shows an intermediate horizontal sectional element and a vertical sectional element which are included in the frame structure, and FIG. 4 is a cross-sectional view of the intermediate horizontal sectional element along the line IV—IV in FIG. 3.

The balcony which is shown in the drawings has a horizontal balcony slab 1 and a horizontal ceiling slab 2 which is located straight above the same and which here constitutes the balcony slab of an upper balcony. Correspondingly, the balcony slab 1 constitutes the ceiling slab of a lower balcony. The two slabs 1 and 2 are concrete or steel slabs, which are conventionally attached to the wall of a house (not shown).

Three U-shaped supports 3 are attached to the balcony slab 1 by means of bolts 4 in such manner that one of their legs 3*a* abuts against the front edge surface 5 of the balcony slab 1 and their other leg 3*b* extends upwards somewhat outside the edge surface 5.

Three U-shaped supports 6, which are identical to the supports 3, are attached to the ceiling slab 2 by means of bolts 7 in such manner that one of their legs 6*a* abuts against the front edge surface 8 of the ceiling slab 2 and that their other leg 6*b* extends upwards somewhat outside the edge surface 8.

The balcony is built in and has at its front four fixed lower wall plates 9 of sheet metal and four glass plates 10, which are horizontally displaceable in relation to each other. The wall plates 9 and the glass plates 10 are mounted in a frame structure according to the invention. The frame structure has an upper horizontal sectional element 11, a lower horizontal sectional element 12, an intermediate horizontal sectional element 13 and two vertical sectional elements 14 and 15. The wall plates 9 are mounted between the lower sectional element 12 and the intermediate sectional element 13. The glass plates 10 are mounted between the upper sectional element 11 and the intermediate sectional element 13 and are displaceable relative to each other in a known manner. The sectional elements 11, 12, 13, 14 and 15 are conveniently made of aluminium.

FIGS. 1 and 2 show a corresponding lower sectional element 12' in an identical frame structure at the upper balcony. The lower balcony also has an identical frame structure (not shown).

The lower sectional element 12 (12') has a longitudinal channel 16 (16') at its underside. The frame structure rests on the lower supports 3 by means of its lower sectional element 12. The outer leg 3*b* of each support 3 is placed in the channel 16 of the lower sectional element 12. The lower sectional element 12 also rests on the front edge surface 5 of the balcony slab 1. The upper sectional element 11 of the frame structure abuts with a vertical flange 17 against the outer leg 6*b* of the upper supports 6 and is attached thereto by means of self-drilling screws (not shown).

The frame structure at the upper balcony is supported in the same manner by the upper supports 6, the lower sectional element 12' resting on the front edge surface 8 of the ceiling slab 2.

The intermediate sectional element 13 of the frame structure according to the invention which is shown in more detail in FIGS. 3 and 4, has at its upper side four parallel ribs 18, which extend in the longitudinal direction of the sectional element and form guides for a respective one of the four glass plates 10 (see FIG. 2), and two edge ribs 19, which extend along the edges of the sectional element.

The intermediate sectional element 13 is a hollow sectional element (see FIG. 4) and extends between the two vertical sectional elements 14 and 15 of the frame structure, which are also hollow sectional elements (see FIG. 3).

The hollow sectional element 13 has in its upper wall a plurality of holes 20 which are formed between the ribs 18, 19, and arranged to conduct water collected in the ducts between the ribs 18, 19 into the interior of the hollow sectional element 13. In its bottom the hollow sectional element 13 has a groove-shaped depression 21, which forms a groove for collecting the water which is conducted into the interior of the hollow sectional element 13. The portion of the hollow sectional element 13 which forms the depression 21, and thus the groove, is somewhat longer than the rest of the hollow sectional element 13 and protrudes in the form of a groove-shaped end portion 22 at each end of the hollow sectional element 13. The end portions 22 extend through a correspondingly formed hole in a rubber packing 23 arranged between the respective ends of a hollow sectional element 13 and the respective vertical hollow sectional elements 14, 15 as well as in the vertical hollow sectional element 14, 15 in order to conduct water into the interior of the vertical hollow sectional element 14, 15. Thus, the two vertical hollow sectional elements 14 and 15 function as downpipes and drain off the water without making the balcony walls dirty.

The two vertical hollow sectional elements 14 and 15 of the frame structure are connected to corresponding vertical hollow sectional elements 14' and 15' respectively in the frame structure of the upper balcony by means of a tubular connecting element in the form of a bellows-like rubber sleeve 24 and 25 respectively. The lower end of the rubber sleeves 24 and 25 is inserted into the upper end of the vertical hollow sectional elements 14 and 15 respectively of the lower frame structure, and their upper end is put onto the lower end of the vertical hollow sectional elements 14' and 15' respectively of the upper frame structure. Thus, the vertical hollow sectional elements 14 and 14' form a continuous downpipe at the one side of the balconies, and the vertical hollow sectional elements 15 and 15' form a continuous downpipe at the other side of the balconies. Correspondingly, the two vertical hollow sectional elements 14 and 15 of the frame structure are connected to the corresponding vertical hollow sectional elements in the frame structure of the lower balcony (not shown).

What is claimed is:

1. A frame structure adapted to be mounted between a horizontal lower balcony slab and a horizontal upper balcony slab located above the lower balcony slab, the frame structure being arranged to support wall plates for at least partial building-in of the space between the balcony slabs, comprising:

a lower horizontal sectional element adapted to be attached to a lower balcony slab;

an upper horizontal sectional element adapted to be attached to an upper balcony slab;

an intermediate horizontal sectional element;

two vertical sectional elements;

the upper horizontal sectional element and the intermediate horizontal sectional element being adapted to support wall plates that are horizontally displaceable relative to each other between the upper horizontal sectional element and the intermediate sectional element; and at least one of the two vertical sectional elements is a hollow vertical sectional element, and the intermediate horizontal sectional element has a water collecting portion including a longitudinal draining groove, the water collecting portion leading to the at least one hollow vertical sectional element, wherein the at least one hollow vertical sectional element has, at at least one of an upper end and a lower end, a tubular connecting element permitting connection of the at least one hollow vertical sectional element to a corresponding hollow vertical sectional element of another frame structure.

2. A frame structure as claimed in claim 1, wherein the intermediate horizontal sectional element is a hollow horizontal sectional element, the interior of the hollow horizontal sectional element forming the groove and having an upper part with holes arranged to conduct water the hollow horizontal sectional element.

3. A frame structure as claimed in claim 2, wherein the draining groove in the hollow horizontal sectional element is a depression in the bottom of the hollow horizontal sectional element.

4. A frame structure adapted to be mounted between a horizontal lower balcony slab and a horizontal upper balcony slab located above the lower balcony slab, the frame structure being arranged to support wall plates for at least partial building-in of the space between the balcony slabs, comprising:

a lower horizontal sectional element adapted to be attached to a lower balcony slab;

an upper horizontal sectional element adapted to be attached to an upper balcony slab;

an intermediate horizontal sectional element;

two vertical sectional elements;

the upper horizontal sectional element and the intermediate horizontal sectional element being adapted to support wall plates that are horizontally displaceable relative to each other between the upper horizontal sectional element and the intermediate sectional element; and at least one of the two vertical sectional elements is a hollow vertical sectional element, and the intermediate horizontal sectional element has a water collecting portion including a longitudinal draining groove, the water collecting portion leading to the at least one hollow vertical sectional element, wherein the at least one hollow vertical sectional element has, at at least one of an upper end and a lower end, a tubular connecting element permitting connection of the at least one hollow vertical sectional element to a corresponding hollow vertical sectional element of another frame structure, wherein the connecting element consists of a rubber sleeve.

5. A frame structure adapted to be mounted between a horizontal lower balcony slab and a horizontal upper balcony slab located above the lower balcony slab, the frame structure being arranged to support wall plates for at least partial building-in of the space between the balcony slabs, comprising:

a lower horizontal sectional element adapted to be attached to a lower balcony slab;

an upper horizontal sectional element adapted to be attached to an upper balcony slab;

an intermediate horizontal sectional element;

two vertical sectional elements;

the upper horizontal sectional element and the intermediate horizontal sectional element being adapted to support wall plates that are horizontally displaceable relative to each other between the upper horizontal sectional element and the intermediate sectional element; and at least one of the two vertical sectional elements is a hollow vertical sectional element, and the intermediate horizontal sectional element has a water collecting portion including a longitudinal draining groove, the water collecting portion leading to the at least one hollow vertical sectional element, wherein the at least one hollow vertical sectional element has, at at least one of an upper end and a lower end, a tubular connecting element permitting connection of the at least one hollow vertical sectional element to a corresponding hollow vertical sectional element of another frame structure, wherein the connecting element comprises a rubber sleeve.

* * * * *